US005626291A

United States Patent [19]

Flinn et al.

[11] Patent Number: 5,626,291

[45] Date of Patent: May 6, 1997

[54] CLEANING SOLUTION SPRAYING SYSTEM

[76] Inventors: Robert A. Flinn, 411 Live Oak Rd.; Alfred E. Flinn, 875 Live Oak La., both of Vero Beach, Fla. 32963

[21] Appl. No.: 338,038

[22] Filed: Nov. 14, 1994

[51] Int. Cl.[6] ..... B05B 7/28

[52] U.S. Cl. ..... 239/310; 239/318

[58] Field of Search ..... 239/310, 318

[56] References Cited

U.S. PATENT DOCUMENTS

| | | | |
|---|---|---|---|
| 2,849,208 | 8/1958 | Skipwith, Jr. | 239/318 |
| 3,231,200 | 1/1966 | Heald | 239/318 |
| 3,776,468 | 12/1973 | Davenport | 239/310 |
| 3,810,787 | 5/1974 | Yoeli et al. | 239/310 |
| 4,651,930 | 3/1987 | Magaha, Jr. | 239/318 |

*Primary Examiner*—Matthew C. Graham

[57] ABSTRACT

A cleaning solution spraying system for cleaning roofs and other outside areas on or about a house that includes in combination (a) a venturi unit, (b) a nozzle unit, (c) coupling hose to connect the venturi unit with a pressurized water stream source, (d) a tubular arrangement to connect the venturi unit with a source of liquid cleaning chemical, (e) a conduit joining the venturi unit to the nozzle unit, (f) a check valve to prevent flow of liquid through the tubular means into the venturi unit, (g) a shut-off valve to prevent flow of liquid through the conduit toward the venturi unit and (h) a check valve to prevent flow of liquid from the venturi unit into the coupling hose.

3 Claims, 1 Drawing Sheet

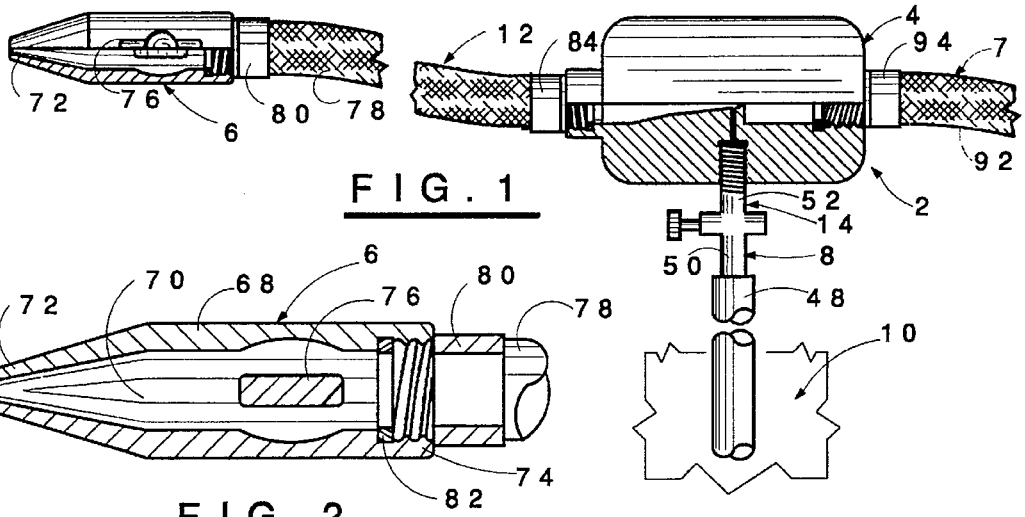
FIG. 1
FIG. 2
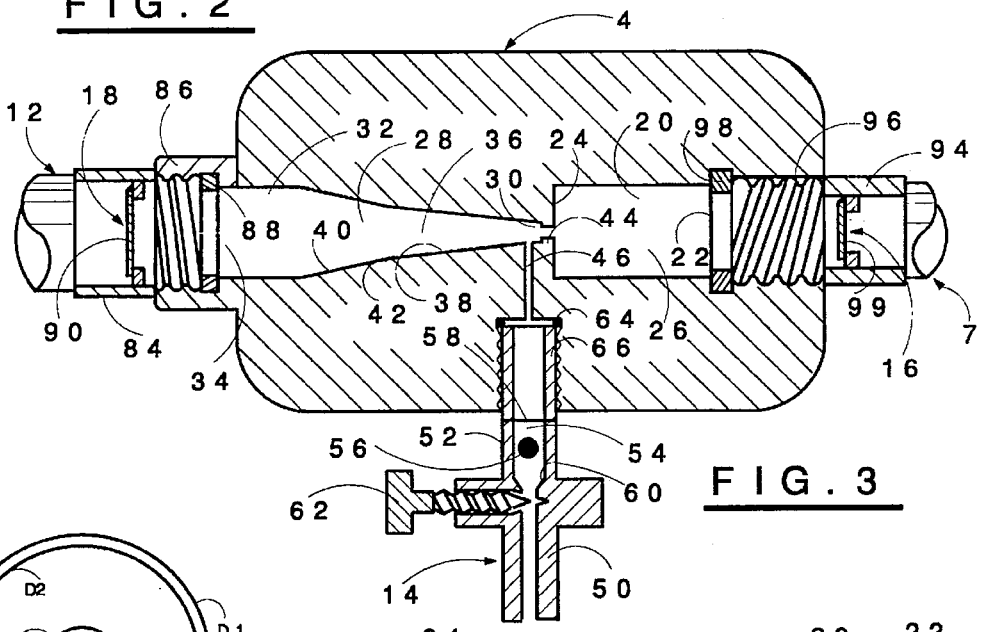
FIG. 3
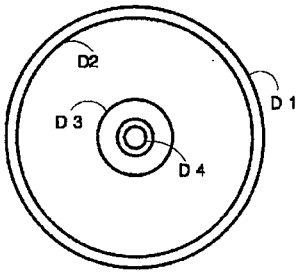
FIG. 5
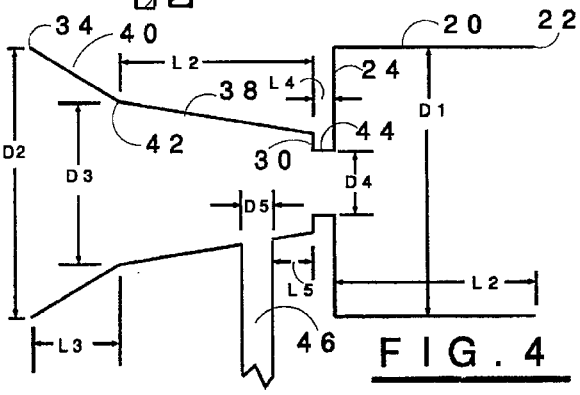
FIG. 4

CLEANING SOLUTION SPRAYING SYSTEM

BACKGROUND OF THE INVENTION

1. Field of the Invention

This application relates to a cleaning solution spraying system. More particularly, it concerns a combination of a venturi mixing unit with a spray unit and other elements forming a system for creating an aqueous cleaning mixture from water and concentrated chlorine solution, with or without adjuvants, to be projected as a pressurized stream onto a roof top or other area to be cleaned.

2. Description of the Prior Art

Roof tops and other exterior house areas, patios, sidewalks, drives and similar outdoor resident areas, RVs, boats, docks, patio furniture, awnings and like canvas, etc. become gradually soiled with mildew, soot and other discoloring agents to such an extent that they require periodic cleansing. Roof areas present special problems including climbing and breakage of often brittle roof tiles or shingles. Consequently, most home owners can not perform roof cleaning and must engage the services of a professional equipped with expensive pressure washing equipment. Hence, there is need for an inexpensive system to enable home owners to safely clean roof areas without need to climb upon the roof and that, at the same time, can enable such owners to effectively clean other exterior areas of the home.

The new system of the invention uses a venturi to mix cleaning chemical with a pressurized stream of water and spray it forcefully thereby providing a 50-foot trajectory of cleaning solution from ground level to a house roof top using normal household water pressure. The general concept of using venturi type devices to mix liquids and to create solution streams or sprays is known, e.g., see U.S. Pat. Nos. 2,246,211 and 4,349,157. The success of the present invention stems from the discovery of a uniquely structured venturi unit that overcomes back-pressure problems typically associated with venturi devices and its combination with other elements to form a system for the efficient, low cost cleaning of home roofs and other exterior areas or objects on or about houses.

OBJECTS

A principal object of the invention is the provision of a cleaning solution spraying system highly effective for the low cost cleaning of home roofs and other exterior areas on or about houses.

Another object is the provision of such a cleaning system capable of providing a 50 foot trajectory of cleaning solution from ground level to roof top utilizing normal household water pressure.

A further object is the provision of such a cleaning system including a venturi unit that is structured to avoid back-pressure problems typically associated with venturi devices.

An additional object is to provide home owners with relatively inexpensive equipment capable of efficiently mixing full strength commercial available chlorine solution in a mix ratio of about 1 part thereof with 10–15 parts of water and spraying it in a precise stream capable of 50 foot trajectories with no pressure assistance except normal household water pressure.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a cleaning solution spraying system comprising (a) a venturi unit, (b) a nozzle unit, (c) coupling means to connect the venturi unit with a pressurized water stream source, (d) tubular means to connect the venturi unit with a source of liquid cleaning chemical, (e) conduit means joining the venturi unit to the nozzle unit, (f) valve means to prevent flow of liquid through the tubular means into the venturi unit, (g) shut-off means to prevent flow of liquid through the conduit means toward the venturi unit and (h) check means to prevent flow of liquid from the venturi unit into the coupling means.

The venturi unit comprises:

(A) a tubular inlet portion defined by (1) a first inlet end, (2) a first outlet end, and (3) a first central passage integrally joining the first inlet end to the first outlet end, (B) a tubular outlet portion of varying longitudinal circular cross-section defined by (1) a second inlet end, (2) a second outlet end and (3) a second central passage integrally joining the second inlet end to the second outlet end, (C) a throttle portion joining the first outlet end to the second inlet end, (D) a lateral conduit positioned adjacent the second inlet end and which communicates with the outlet portion of the venturi unit, (E) first connection means associated with the first inlet end to connect the venturi unit to the coupling means, and (F) second connection means associated with the second outlet end to connect the venturi unit to the conduit means.

The second central passage of the venturi unit is defined by (i) an inflow section and (ii) an outflow section. Such inflow section tapers outwardly from the second inlet end toward the outflow section and the inflow section is connected by a circular junction to the outflow section. Also, the outflow section tapers outwardly from such circular junction toward the second outlet end of the tubular outlet portion of the venturi unit.

The ability of the new spraying system to project a coherent stream of cleaning solution for distances of 50 feet or more simply via the use of household water pressure results from the unique geometric and size relationships of the various components of the venturi unit which are described in detail below.

BRIEF DESCRIPTION OF THE DRAWINGS

A more complete understanding of the invention can be obtained by reference to the accompanying drawings in which:

FIG. 1 is fragmented lateral view of a cleaning solution spraying system of the invention.

FIG. 2 is an enlarged sectional view of the nozzle unit of the spraying system of FIG. 1.

FIG. 3 is an enlarged sectional view of the venturi unit of the spraying system of FIG. 1.

FIG. 4 is a lateral diagram of the spatial relationships of various components of preferred venturi units useable in accordance with the invention.

FIG. 5 is a axial diagram of the spatial relationships of various components of preferred venturi units useable in accordance with the invention.

DESCRIPTION OF THE PREFERRED EMBODIMENTS

Referring in detail to the drawings, the cleaning solution spraying system 2 constructed in accordance with the invention comprises a venturi unit 4, a nozzle unit 6, coupling means 7 to connect the venturi unit with a pressurized water stream source (not shown), tubular means 8 to connect the venturi unit 4 with a source 10 of liquid cleaning chemical, conduit means 12 joining the venturi unit 4 to the nozzle unit 6, valve means 14 to control flow of liquid from the tubular means 8 into the venturi unit 4, check means 16 to prevent flow of liquid from the venturi unit 4 back into the coupling means 7 and shut-off means 18 to prevent flow of liquid from said conduit means 12 into said venturi unit 4.

The source 10 typically will be a plastic bottle or jug filed with 5–10% aqueous chlorine solution, possibly containing wetting agents, detergents, etc. The water stream source typically will be a threaded spigot of a household water system.

For a detailed description of the venturi unit 4, reference in made to FIGS. 3–5. It comprises a tubular inlet portion 20 of length L1 defined by a first inlet end 22 including a circular inlet opening of diameter D1, a first outlet end 24, and a first central passage 26.

Unit 4 also has a tubular outlet portion 28 of varying longitudinal circular cross-section defined by a second inlet end 30, a second outlet end 32 including a circular outlet opening 34 of diameter D2 and a second central passage 36. The passage 36 is defined by an inflow section 38 of length L2 and an outflow section 40 of length L3.

The inflow section 38 tapers outwardly from the second inlet end 30 toward the outflow section 40 and forms a circular junction 42 having a diameter of D3 with the outflow section 40. Also, the outflow section 40 tapers outwardly from the inflow section 30 toward the second outlet end 32.

The venturi unit 4 further has a throttle portion 44 of circular cross-section having a diameter D4 and a axial length L4 joining the first outlet end 24 to the second inlet end 30. Adjacent the portion 44, there is a lateral conduit 46 of circular cross-section having a diameter D5 and is positioned a distance L5 from the second inlet end 30. This conduit 46 communicates with the inflow section 38 of the central passage 36 and functions during operation of the venturi unit 4 to inject concentrated cleaning solution from source container 10 into the flow of water passing through throttle portion 44 and passage 36.

In a preferred spraying system of the invention, the diameter D5=0.0625 inch (1.588 mm.) and the other critical diameters and lengths bear the following relative values with D5=1: D1=12, D2=11, D3=4, D4=3, L1=12, L2=12 and L3=6.

The tubular means 8, which serves to convey liquid from container 10 to the conduit 46 comprises the valve means 14 and a length of depending tubing 48 attached to the inlet nipple 50 of valve means 14.

In addition to nipple 50, valve mean 14 includes a threaded connector nipple 52 containing tubular chamber 54 that encloses check ball 56 which is captured by the pin 58. In operation of the system 2, the ball 56 functions by engagement with seat 60 to prevent pressurized water to flow into container 10 via tubular means 8 from coupling means 7.

Valve means 14 further includes a threaded needle valve 62 that can be used to regulate the flow of solution from container 10 into the venturi unit 4 or to supplement the check ball 56 in completely sealing off the container 10 from the venturi unit 4.

An O-ring 64 serves to seal the connector nipple 52 in the threaded outlet 66 of the lateral conduit 46.

Nozzle unit 6 comprises a cylinder 68 defining passage 70, a ported tip 72, a threaded female coupling end 74 and a shut-off valve 76.

Conduit means 12 comprises flexible hose 78, male coupling end 80 which threads into end 74 against gasket 82 and male coupling end 84 which threads into first connection means 86 on the second outlet end 32 of venturi unit 4 against gasket 88.

The shut-off means 18 contained in the coupling end 84 comprises a flapper-type check valve 90, but other type shut-off devices may be used and may be located at other positions in the venturi unit 4 or conduit means 12.

Coupling means 7 comprises flexible hose 92, male coupling end 94 which threads into second connection means 96 on the first inlet end 22 of venturi unit 4 against gasket 98.

The check means 16 contained in the coupling end 94 comprises a flapper-type check valve 99, but other type shut-off devices may be used and may be located at other positions in the venturi unit 4 or coupling means 7.

In use of the spraying system 2, 5–10% chlorine water is charged into the container 10 and the coupling hose 7 is attached to a house water faucet. With the valve 76 of the nozzle unit 6 closed, the water faucet is turned on to introduce pressurized water through the hose 7 into the system 2. The nozzle 6 is then positioned to eject a stream of cleaning solution onto a house roof or other area to be cleaned and the valve 76 is turned to emit the cleaning solution stream. The system 2 produces a steady coherent stream of cleaning solution which quickly serves to remove mildew and other soil from the roof or other area being treated. During the cleaning operation, the amount of chemical solution mixing in unit 4 with the incoming water from hose 7 can be controlled by adjustment of the needle valve 62.

When, during the course of the cleaning operation, it becomes necessary to temporarily stop the ejection of the cleaning solution stream by closing the valve 76 of the nozzle, the check valve 18 prevents solution in the nozzle 6 and the conduit 12 from backing up into the unit 4, check valve 16 prevents cleaning solution from backing up into the hose 7 and the ball valve 56 prevents solution in the unit 4 from entering the container 10.

The embodiments of the invention in which an exclusive property or privilege is claimed are defined as follows:

1. A cleaning solution spraying system comprising:

a venturi unit, a nozzle unit including a shut-off valve, coupling means to connect said venturi unit with a pressurized water stream source, tubular means to connect said venturi unit with a source of liquid cleaning chemical, said tubular means including an adjustable valve means, conduit means joining said venturi unit to said nozzle unit, a first check valve means to prevent flow of liquid from said venturi unit through said tubular means and a second check valve means to prevent flow of liquid from said venturi unit through said coupling means, a third check valve means to prevent flow from said nozzle unit to said venturi unit, said venturi unit comprises:

a tubular inlet portion of length L1 defined by a first inlet end including a circular inlet opening of diameter D1, a first outlet end, and a first central passage integrally joining said first inlet end to said first outlet end, an tubular outlet portion of varying longitudinal circular cross-section defined by:

a second inlet end, a second outlet end including a circular outlet opening of diameter D2 and a second central passage integrally joining said second inlet end to said second outlet end, said second central passage being defined by an inflow section of length L2 and an outflow section of length L3, said inflow section tapering outwardly from said second inlet end toward said outflow section, the circular junction of said inflow section with said outflow section having a diameter of D3, said outflow section tapering outwardly from said inflow section toward said second outlet end, and a throttle portion of circular cross-section having a diameter D4 and a longitudinal length L4 joining said first outlet end to said second inlet end, a lateral conduit of circular cross-section of diameter D5 positioned a distance L5 from said second inlet end communicating with said inflow section, first connection means associated with said first inlet end to connect said venturi unit to said coupling means, and second connection means associated with said second outlet end to connect said venturi unit to said conduit means.

2. The spraying system of claim 1 wherein said diameters and lengths bear the following relative values:

D1=12, D2=11, D3=4, D4=3, D5=1, L1=12, L2=12 and L3=6.

3. The spraying system of claim 2 wherein D5=0.0625 inch (1.588 mm.).

* * * * *